US006642827B1

(12) United States Patent
McWilliams et al.

(10) Patent No.: US 6,642,827 B1
(45) Date of Patent: Nov. 4, 2003

(54) ADVANCED ELECTRONIC MICROMINIATURE COIL AND METHOD OF MANUFACTURING

(75) Inventors: Michael D. McWilliams, Oceanside, CA (US); George Jean, Chula Vista, CA (US); Jacobus J. M. VanderKnyff, Oceanside, CA (US)

(73) Assignee: Pulse Engineering, San Diego, CA (US)

( * ) Notice: Subject to any disclaimer, the term of this patent is extended or adjusted under 35 U.S.C. 154(b) by 210 days.

(21) Appl. No.: 09/661,628

(22) Filed: Sep. 13, 2000

(51) Int. Cl.[7] ..... H01F 27/04

(52) U.S. Cl. ..... 336/107; 336/196; 336/206; 29/602.1

(58) Field of Search ..... 336/107, 192, 336/206; 29/602.1

(56) References Cited

U.S. PATENT DOCUMENTS

| | | | | |
|---|---|---|---|---|
| 4,493,138 A | | 1/1985 | Gibbs et al. | |
| 4,847,986 A | | 7/1989 | Meinel | |
| 4,988,968 A | | 1/1991 | Tochio et al. | |
| 5,015,981 A | | 5/1991 | Lint et al. | |
| 5,091,253 A | | 2/1992 | Smith et al. | |
| 5,300,911 A | | 4/1994 | Walters | |
| 5,380,320 A | | 1/1995 | Morris | |
| 5,487,214 A | | 1/1996 | Walters | |
| 5,541,567 A | * | 7/1996 | Fogel et al. | 174/260 |
| 5,838,220 A | * | 11/1998 | Hagberg | 336/206 |
| 5,898,991 A | | 5/1999 | Fogel et al. | |
| 5,917,397 A | | 6/1999 | Sasahara | |
| 6,056,890 A | | 5/2000 | Cai et al. | |
| 6,116,963 A | | 9/2000 | Shutter | |
| 6,165,340 A | | 12/2000 | Andrus et al. | |
| 6,225,560 B1 | * | 5/2001 | Machado | 174/52.2 |
| 6,243,940 B1 | * | 6/2001 | Rund et al. | 29/608 |
| 2001/0010487 A1 | * | 8/2001 | Saito et al. | 335/299 |
| 2002/0056186 A1 | * | 5/2002 | De Graaf | 29/606 |

FOREIGN PATENT DOCUMENTS

| | | | | |
|---|---|---|---|---|
| DE | 0 821 375 A1 | | 1/1998 | |
| GB | 2259610 A | * | 3/1993 | H01F/27/28 |
| JP | 59067615 | | 4/1984 | |
| JP | 03012906 | | 1/1991 | |
| JP | 07263261 | | 10/1995 | |
| WO | WO 00/26027 | | 5/2000 | |

* cited by examiner

*Primary Examiner*—Elvin Enad
*Assistant Examiner*—Jennifer A. Poker
(74) *Attorney, Agent, or Firm*—Gazdzinski & Associates

(57) ABSTRACT

An advanced microelectronic coil device incorporating a toroidal core and a plurality of sets of windings, wherein the windings are separated by one or more layers of insulating material. In one embodiment, the insulating material is vacuum-deposited over the top of a first set of windings before the next set of windings is wound onto the core. In this fashion, the insulating material insulates the entire first winding from the second without the need for individual insulation on each of the windings, or the use of margin tape. The use of the vacuum-deposited insulating layer(s) provides a high degree of dielectric strength, yet consumes a minimum space since the insulation on each winding is minimized. The toroidal core is also optionally provided with a controlled thickness gap for controlling saturation of the core.

18 Claims, 19 Drawing Sheets

PART 1 OF 3

PART 2 OF 3

PART 3 OF 3

ADVANCED ELECTRONIC MICROMINIATURE COIL AND METHOD OF MANUFACTURING

BACKGROUND OF THE INVENTION

1. Field of the Invention

The present invention relates generally to microminiature electronic elements and particularly to an improved design and method of manufacturing microminiature electronic components including toroidal transformers and inductive reactors (i.e., "choke coils").

2. Description of Related Technology

For many years, electronic circuit boards have been fabricated by interconnecting a plurality of electronic components, both active and passive, on a planar printed circuit board. Typically, this printed circuit board has comprised an epoxy/fiberglass laminate substrate clad with a sheet of copper, which has been etched to delineate the conduct paths. Holes were drilled through terminal portions of the conductive paths for receiving electronic component leads, which were subsequently soldered thereto.

More recently, so-called surface mount technology has evolved to permit more efficient automatic mass production of circuit boards with higher component densities. With this approach, certain packaged components are automatically placed at pre-selected locations on top of a printed circuit board so that their leads are registered with, and lie on top of, corresponding solder paths. The printed circuit board is then processed by exposure to infrared, convection oven or vapor phase soldering techniques to re-flow the solder and, thereby, establish a permanent electrical connection between the leads and their corresponding conductive paths on the printed circuit board.

The increasing miniaturization of electrical and electronic elements and the high density mounting of such elements has created increasing problems with electrical isolation and mechanical interconnection. As circuit board real estate becomes increasingly more valuable, more and more components are put into increasingly smaller spaces, thereby generally increasing the heat generation per square millimeter of circuit board, as well as the likelihood of electrical and electromagnetic interference (EMI) between components in such close proximity. Such factors strongly militate in favor of components that utilize the absolute minimum footprint, and have acceptable heat and EMI signatures in addition to the desired electrical performance.

One very commonly used component is the transformer. As is well known in the art, transformers are electrical components that are used to transfer energy from one alternating current (AC) circuit to another by magnetic coupling. Generally, transformers are formed by winding one or more wires around a ferrous core. One wire acts as a primary winding and conductively couples energy to and from a first circuit. Another wire, also wound around the core so as to be magnetically coupled with the first wire, acts as a secondary winding and conductively couples energy to and from a second circuit. AC energy applied to the primary windings causes AC energy in the secondary windings and vice versa. A transformer may be used to transform between voltage magnitudes or current magnitudes, to create a phase shift, and to transform between impedance levels.

Another purpose for which microelectronic transformers are commonly used is to provide physical isolation between two circuits. For example, a transformer may be used to provide isolation between a telephone signal line and the Central Office (CO), and in the public switched telephone network and consumer equipment such as modems, computers and telephones, or between a local area network (LAN) and a personal computer. Often, the transformer must be able to withstand large voltage spikes which may occur due to lightning strikes, malfunctioning equipment, and other real-world conditions without causing a risk of electrical shock, electrical fire or other hazardous conditions.

In furtherance of these ends, the electrical performance of the transformer must be carefully considered. One means by which the electrical performance of transformers is gauged is the Dielectric Withstanding Voltage (DWV) or hi-pot test. A hi-pot test involves the application of AC or DC signals to the transformer to determine whether the breakdown of the core dielectric or other destructive failures occur at some chosen voltage level. A hi-pot test can also be used to demonstrate that insulation can withstand a given overvoltage condition (such as the aforementioned voltage spikes) and to detect weak spots in the insulation that could later result in in-service failures.

The International Electro-Technical Commission is an international standards body that develops the standards by which isolation transformers are categorized according to level of safety. Underwriter's Laboratories Standard 1950 (UL-1950) is the corresponding harmonized national adaptation for the United States. It specifies a minimum standard for dielectric breakdown between the primary and secondary windings of a transformer. Under UL-1950, insulation systems used in transformers are classified as Operational, Basic, Supplementary, or Reinforced. The most common classification for transformers used in telecommunications application is Supplementary.

In order to meet a standard such as UL-1950, it is critical that the primary and secondary windings are electrically isolated and/or physically separated from one another while remaining magnetically coupled to one another through the transformer core. The standard provides for (or allows) the use of: (1) required minimum spacing distances, (2) minimum thickness of solid insulating material, or (3) a minimum number of layers of a thin film of insulation for compliance. When the use of layers of a thin film of insulation is the means selected to provide electrical isolation between windings in the transformer, the standard states that a minimum of two layers must be used. Each of the layers must individually pass the DWV requirement. Three layers may also be used, in which case the DWV requirement must be met by testing combinations of two layers at a time. An option provided under the standard is to apply the thin films directly to a conductor as in the case of a wire having two or three extrusions of film material deposited directly over the copper conductor.

Magnet wire is commonly used to wind transformers and inductive devices (such as inductors or choke coils). Magnet wire is made of copper or other conductive material coated by a thin polymer insulating film or a combination of polymer films such as polyurethane, polyester, polyamide, and the like. The thickness and the composition of the film coating determine the dielectric strength capability of the wire. Magnet wire in the range of 31 to 42 AWG is most commonly used in microelectronic transformer applications, although other sizes may be used in certain applications.

Note that where Supplementary or Reinforced insulation is required by the cognizant safety agencies for specific applications, such as in the case of the aforementioned UL standard, the enamel insulation used on magnet wire is generally not sufficient. In these cases, the transformers need to be built such that additional insulation between the windings is provided. This is often achieved by adding insulating tape between the windings and additional tape in the margins of the winding form to provide spacing to ensure that the required minimum distance between the primary and secondary windings is maintained. While useful in certain types of transformers, such "margin" tape is not well adapted to very small transformers, and toroidal cores in particular.

Hence, under the prior art, the designer is left with the choice of using margin tape and layers of thin insulation or individually insulated wires in order to meet the dielectric requirements set forth in the applicable standards. One major disability with the use of individually insulated wires in transformer applications is space. Specifically, since each conductor is insulated with its own layers of insulation (typically on the order of a few mils thickness), it can be readily appreciated that the space required by many layers of such conductors wound atop each other is very much greater than that required by the same size (e.g., AWG) conductors without the insulation. Hence, any transformer which uses individually insulated conductors such as those described above would necessarily be much larger in size that a comparable transformer without insulation, if the latter could be made to work and still meet its electrical performance and safety agency requirements.

FIG. 1*a* illustrates one prior art microelectronic transformer arrangement commonly used, often referred to as a "shaped" core. The core 102 of the device 100 of FIG. 1*a* is formed from two half-pieces 104, 106, each having a truncated semi-circular channel 108 formed therein and a center post element 110, each also being formed from a magnetically permeable material such as a ferrous compound. As shown in FIG. 1, each of the half-pieces 104, 106 are mated to form an effectively continuous magnetically permeable "shell" around the windings 112*a*, 112*b*, the latter which are wound around a spool-shaped bobbin 109 which is received on the center post element 110. When completely assembled, the device 100 is mounted on top of a terminal array 114 generally with the windings 112*a*, 112*b* (i.e., the truncated portions 116 of the half-pieces 104, 106) being adjacent to the terminal array 114, which is subsequently mated to the printed circuit board (PCB) when the device 100 is surface mounted as shown in FIG. 1*b*. Note that the truncated portions are present, inter alia, to allow termination of the windings 112 outside of the device 100. Margin tape 119 is applied atop the outer portions of the outer winding 112*b* for additional electrical separation.

FIG. 1*c* illustrates a cross-section of the device 100 after assembly, and accordingly some of the disabilities associated with this design. As shown in FIG. 1*c*, the magnetic coupling between the permeable half-pieces 104, 106 and the windings is non-optimized because of the presence of the truncated portion 116 consisting of insulating tape. In addition, the design of FIGS. 1*a*–1*c* is not optimized in terms of volume and footprint. A significant amount of volume is devoted not only to the half-pieces 104, 106, semi-circular channel 108, and bobbin 109, but also to the windings themselves. As previously described, it is common to use either individually insulated conductors and/or margin tape in order to provide the desired degree of insulation between the windings 112*a*, 112*b* of the device 100, both of which require substantial additional space.

In terms of footprint, even when the device is oriented with respect to the terminal array 114 and PCB 120 as shown in FIGS. 1*b* and 1*c* (which arguably requires the smallest footprint on the PCB when compared to other possible orientations of the half-pieces 104, 106), the size of the footprint 122 is still comparatively large, owing in substantial part to the use of individually insulated conductors and/or margin tape.

Other disabilities associated with the transformer arrangement of FIGS. 1*a*–1*c* include the necessity to accurately align the two halves 104, 106 of the core during manufacturing, as well as the requirement that the mating surfaces of the two halves be very smooth and planar. As is well known, the alignment of the two magnetically permeable halves of the shaped core will affect the magnetic (and therefore electrical) performance of the device; imperfect alignment or matching of the halves causes spatial variations in the flux density, and therefore also in the energy coupled between the windings. Similarly, if the mating surfaces of the halves are not smooth and planar (i.e., flat), variations in magnetic coupling occur as well. Such variations can be significant in magnitude, and can result in substantial variations in the electrical performance of one device as compared to another manufactured using the same process. Ideally, all transformers manufactured using the same components and processes would have identical electrical performance; hence, the foregoing inherent variations in the shaped core transformer make it a less-than-perfect design from a performance standpoint. When coupled with the aforementioned spatial restrictions, and the additional labor required to make use of individually insulated conductor and/or margin tape, the shaped core design becomes even less desirable.

Another well-known configuration for a microelectronic transformer comprises a toroidal ferrite core. A toroidal transformer can readily be adapted to provide any one of the transformer functions listed above. One significant drawback to the use of toroidal cores, however, is the inability to use the device in conjunction with individually insulated conductors (e.g., additional insulation such as a Teflon® coating disposed over or in place of the normal polyurethane or similar coating on the conductors) or margin tape. While a microelectronic toroidal core may be successfully wound with primary and secondary windings comprising fine gauge magnet wire, the use of more heavily insulated windings is precluded based on the limited size of the device. Furthermore, it is exceedingly difficult to utilize margin tape on a toroid, since it significantly limits the winding area (i.e., "window"), and cannot be placed on the core mechanically as on a bobbin, but rather must be manually placed. Manual placement such as this greatly increases the cost of manufacturing each device. In addition, placement of the windings on the toroid would have to be such that the required electrical performance and separation parameters could not be satisfied. Hence, prior art toroid core transformers that are required to meet the stringent dielectric performance requirements previously discussed are practically limited to a certain minimum size, which is often much too large for the desired application.

It should be noted that an additional consideration in choosing between the aforementioned prior art "shaped" core and toroidal core configurations relates to the use of an air gap within the transformer for control of core saturation. Designers have heretofore been generally forced in the direction of using a shaped core as opposed to a toroidal core in such applications, since the use of an air gap in the toroid core has presented difficulties not existing in the shaped core. Specifically, the mechanical reliability of gapped toroids has been questionable at best, and the cost of producing these components significantly higher than a shaped core transformer of equivalent capability. Furthermore, only a very limited number (i.e., one) of vendors currently produce such a component. These practical barriers to the use of a toroid core transformer with an air gap have accordingly restricted the options open to the designer when designing a transformer for a specific application, a potentially severe disability in cases such as where the reduced size or other desirable features of the toroid core are required.

Based on the foregoing, it would be most desirable to provide an improved microelectronic component and method of manufacturing the same. Such an improved device would provide a high dielectric strength between individual windings of the device (such as the primary and secondary windings of the aforementioned toroidal core transformer), while occupying a minimum volume. Additionally, such improved device would have a minimal footprint (or alternatively, larger footprint and lower vertical height from the substrate), and could be manufactured easily and cost-efficiently, with little or no variation in electrical performance from device to device. Such device would also readily accommodate an air gap if desired by the designer, without other adverse effects.

SUMMARY OF THE INVENTION

The present invention satisfies the aforementioned needs by providing an improved microelectronic device, and method of manufacturing the same.

In a first aspect of the invention, an improved microelectronic toroidal element for use in, inter alia, surface mount applications and microelectronic connectors is disclosed. In one exemplary embodiment, the toroidal element comprises a transformer having a toroidal core fashioned from magnetically permeable material; a first winding (e.g., primary) wound around the toroid in a layered fashion; a layer or a plurality of layers of polymeric insulating material (e.g., Parylene) formed over the top of the first winding; at least one second winding (i.e., secondary) wound around the toroid and over the top of the insulating material. The application of the insulating material is controlled such that the required dielectric properties are obtained over the length of the windings including the free ends that terminate external to the element. A vacuum deposition process is advantageously used for the application of the Parylene thereby providing the maximum degree of uniformity of material thickness, which in turn allows for the smallest possible physical profile of the device. One or more gaps are also optionally provided in the toroidal core so as to meet electrical and magnetic parameters such as energy storage and minimal changes over temperature.

In a second aspect of the invention, an improved microelectronic package incorporating the aforementioned toroidal element is disclosed. In one embodiment, the package comprises a toroidal core transformer having a gap, first winding, Parylene insulation layer(s), and second winding as described above, the toroid being mounted on terminal array in a vertical orientation (i.e., such that the plane of the toroid is normal to the plane of the terminal array and the substrate to which the latter may be affixed) with respect thereto. The free ends of the first and second windings are conductively joined with the conductive terminals of the terminal array, thereby forming a conduction path through each of the transformer windings to and from the traces or vias of the substrate. The toroid is advantageously held in place by the tension of the free ends of the windings being joined to the terminals of the array, thereby obviating the need for a separate retention mechanism. The package is also optionally encapsulated with a polymer encapsulant for enhanced mechanical strength and environmental isolation. In a second embodiment, one or more toroid elements are disposed within a mounting base (such as an "interlock" base), the latter having a plurality of preformed lead channels in which are received respective electrical leads used for mounting the package to the substrate. The toroid windings are coated up to the point of entering the lead channels, thereby assuring adequate electrical separation between the toroid and the winding egress. The mounting base, including toroid and windings, are also optionally encapsulated.

In a third aspect of the invention, an improved circuit board assembly incorporating the aforementioned microelectronic package is disclosed. In one exemplary embodiment, the assembly comprises a substrate having a plurality of conductive traces disposed thereon with the microelectronic assembly bonded thereto such that the leads or terminals of the package are in contact with the traces, thereby forming a conductive pathway from the traces through the toroid windings of the package.

In a fourth aspect of the invention, an improved microelectronic connector assembly incorporating the aforementioned toroid element is disclosed. In one embodiment, the connector comprises an RJ-type connector (e.g., RJ-11 or RJ-45) having a body and a receptacle formed therein, the receptacle having a plurality of electrical contacts for mating with the contacts of a modular plug received within the receptacle; a cavity disposed within the body; and at least one toroid element having a plurality of windings of the type previously described disposed with the cavity. One set of windings of the toroid is coupled to the terminals of the aforementioned electrical contacts, thereby forming a conductive pathway from the contacts of the modular plug through the contacts and terminals of the connector and through the windings of the toroid element. A set of leads connecting the second set of toroid windings to an external device (such as a PCB) are also provided. The cavity of the connector is optionally filled with an epoxy or other encapsulant if desired.

In a fifth aspect of the invention, an improved method of manufacturing the toroid core element of the present invention is disclosed. The method generally comprises the steps of providing a toroidal transformer core; forming a gap within the core; winding the toroidal transformer core with a first set of windings; depositing on the first set of windings at least one layer of an insulating coating; winding the core with a second set of windings; and terminating the first and second sets of windings to a terminal array. In one embodiment, the insulating coating is Parylene, a thermoplastic polymer, which is deposited on the first set of windings using a vacuum deposition process. The toroid elements with first winding are hung from a lateral support member within the vacuum deposition chamber such the desired length of leads is exposed to the deposition process. A layer of insulating material is also optionally deposited over the core before the first set of windings is applied in order to mitigate chafing or abrasion of the conductors during the winding process. After the second set of windings is applied over the toroid, the device is terminated and optionally encapsulated with an epoxy or other encapsulant.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Reference is now made to the drawings wherein like numerals refer to like parts throughout.

It is noted that while the following description is cast primarily in terms of a toroidal core transformer having at least two windings, the present invention may be used in conjunction with any number of different microelectronic components including without limitation inductive reactors (e.g., common mode choke coils), and coupled inductors. Conceivably, any device having a plurality of winding turns and requiring electrical insulation may benefit from the application of the approach of the present invention. Accordingly, the following discussion of the toroidal core transformer is merely exemplary of the broader concepts.

Figure 1A:
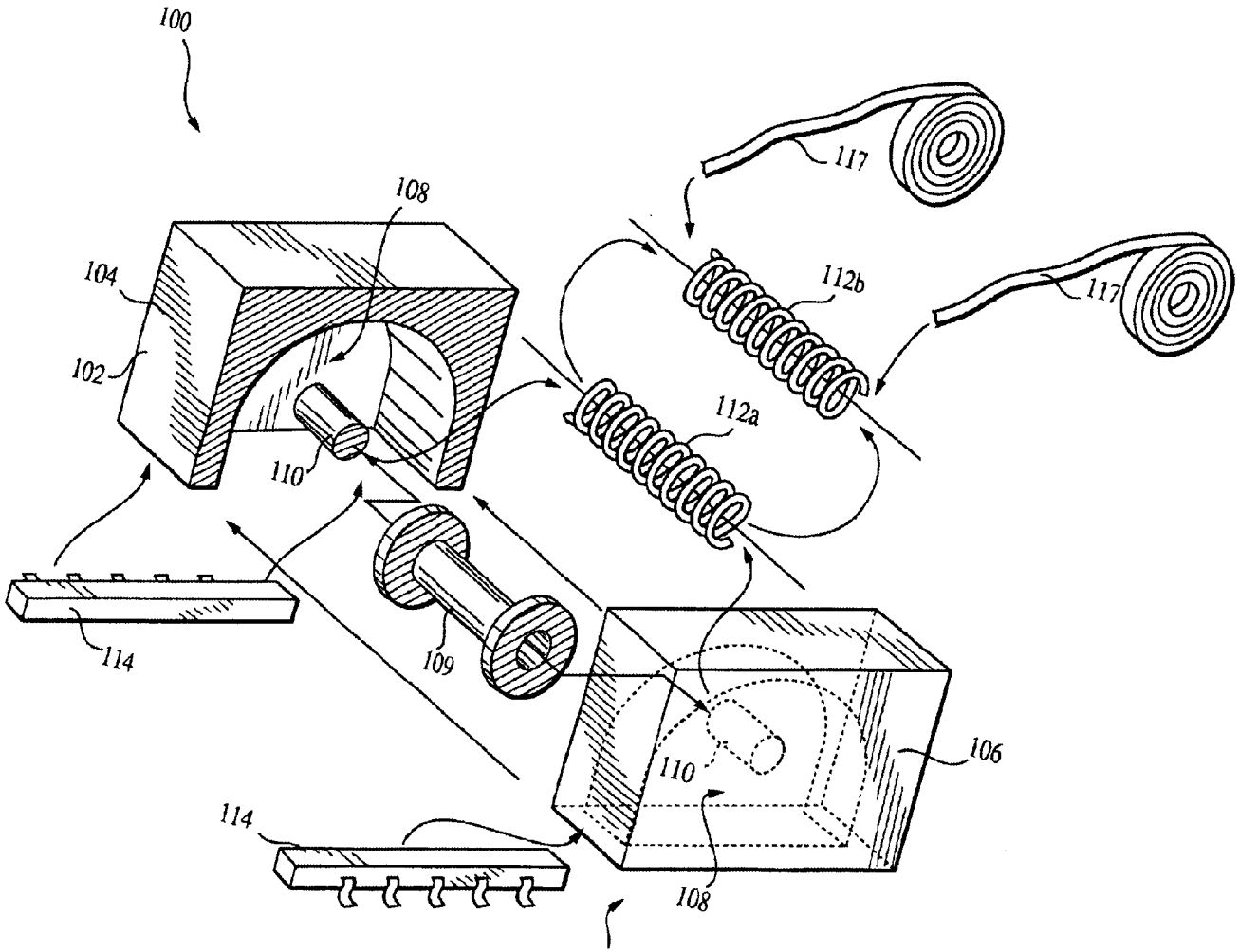
FIG. 1*a* is a perspective assembly view of a typical prior art transformer design shaving a two piece core, illustrating the components thereof.
Figure 1B:
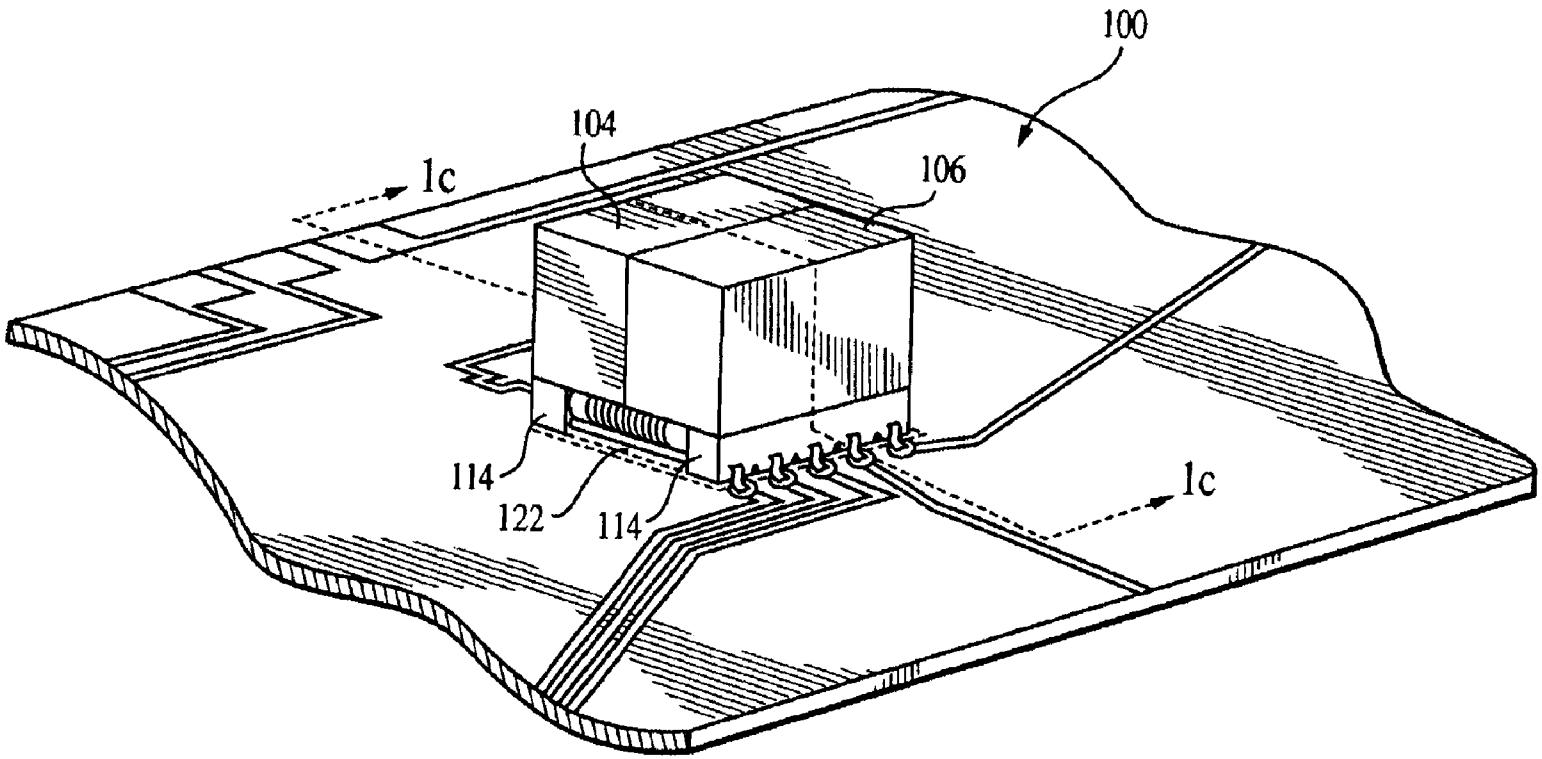
FIG. 1b PRIOR ART
FIG. 1*b* is a perspective view of the transformer of FIG. 1*a* after assembly and mounting on a substrate (PCB).
Figure 1C:
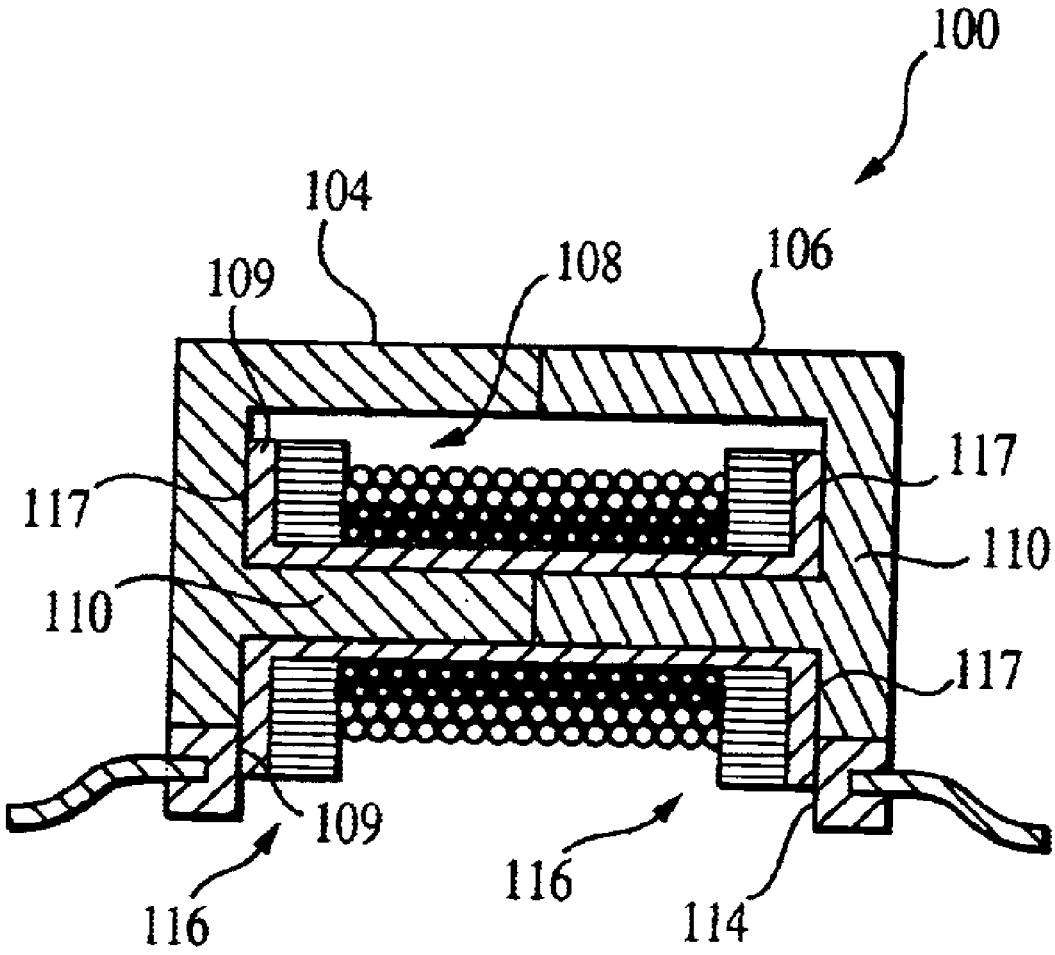
FIG. 1c PRIOR ART
FIG. 1*c* is a cross-sectional view of the assembled transformer of FIG. 1*b* taken along line 1—1, illustrating the relationship of the various components.
Figure 2A:
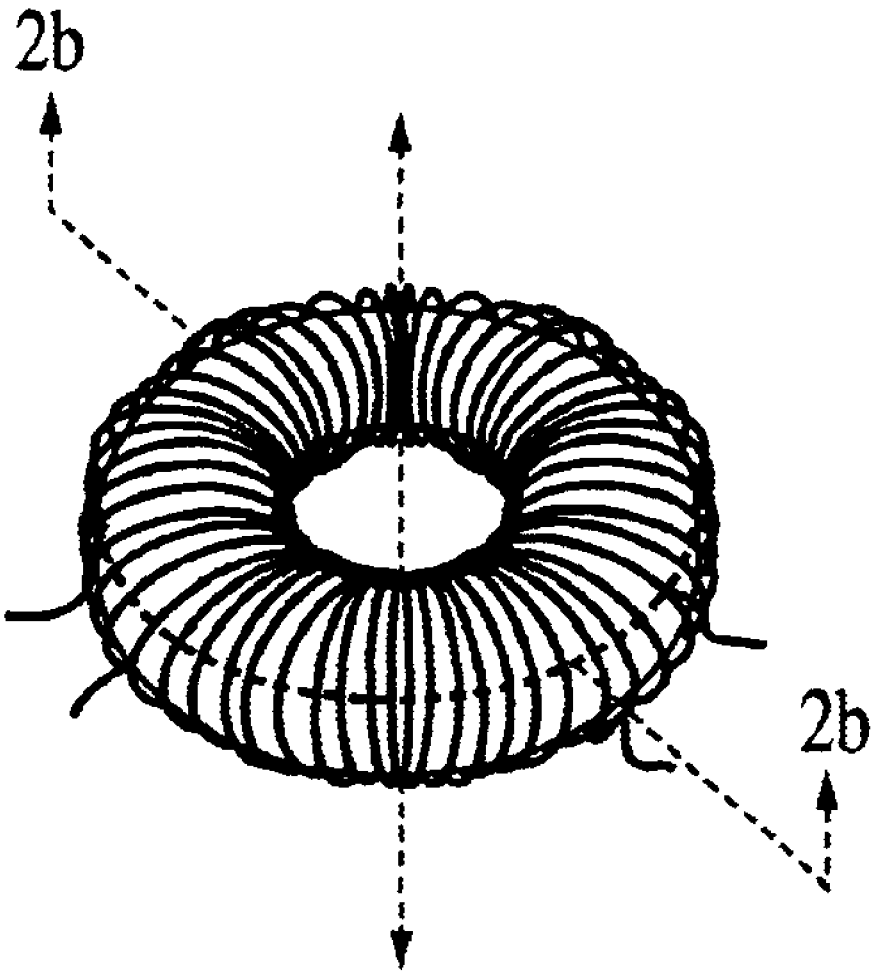
FIG. 2a PRIOR ART
FIGS. 2*a* and 2*b* are perspective and cross-sectional views, respectively, of a typical prior art toroidal core transformer, illustrating the construction thereof.
Figure 2B:
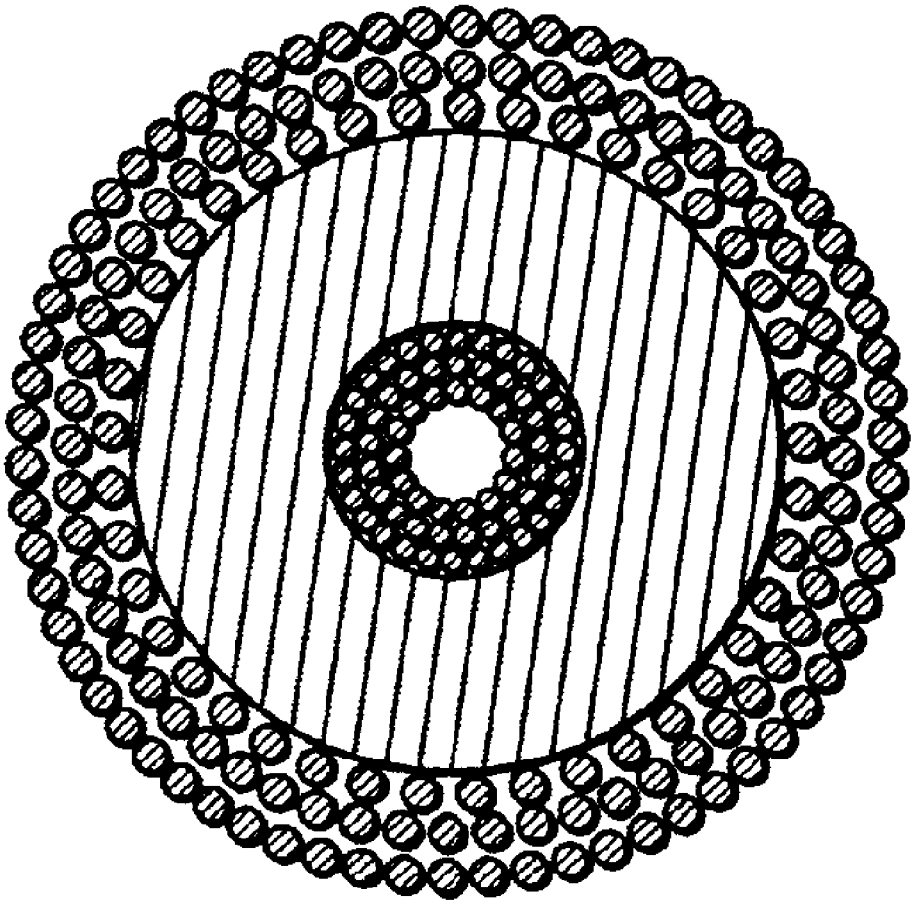
FIG. 2b PRIOR ART
Figure 3A:
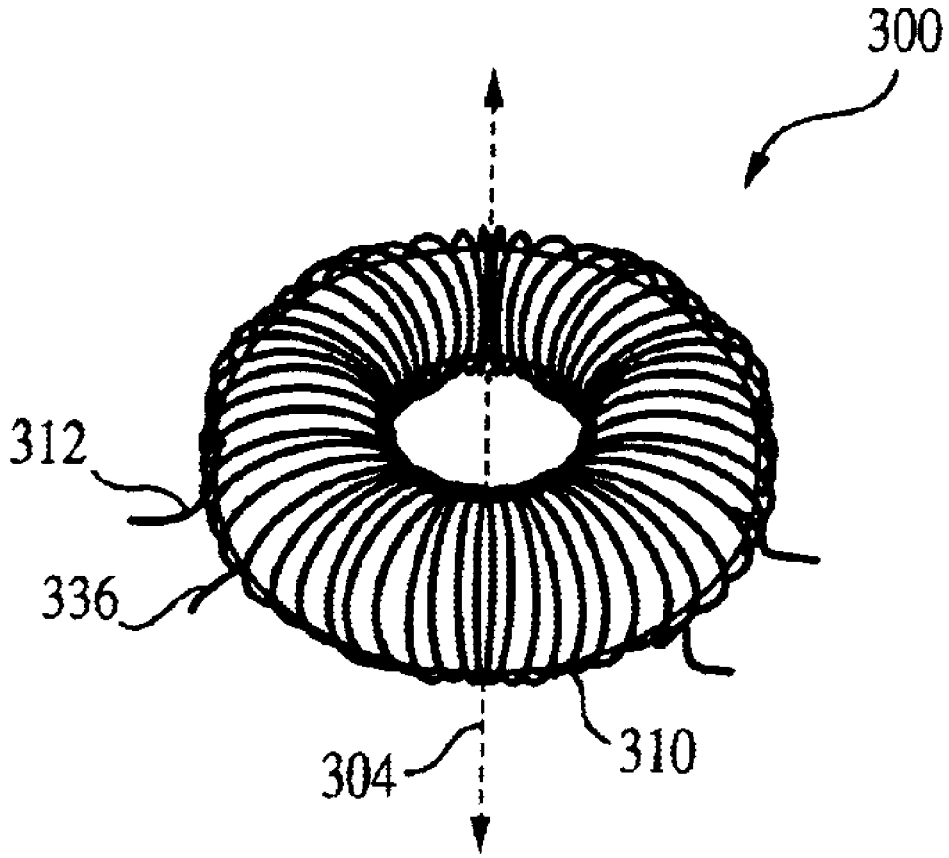
FIGS. 3*a* and 3*b* are perspective and cross-sectional views, respectively, of exemplary embodiments of a toroid core transformer element according to the present invention, including polymer insulation layer.
Figures 1, 3B:
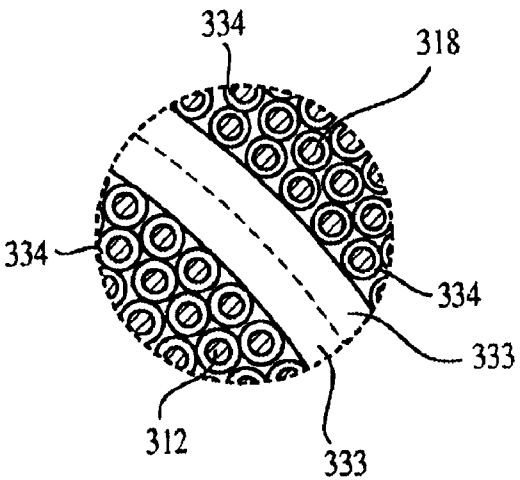
Figure 3B:
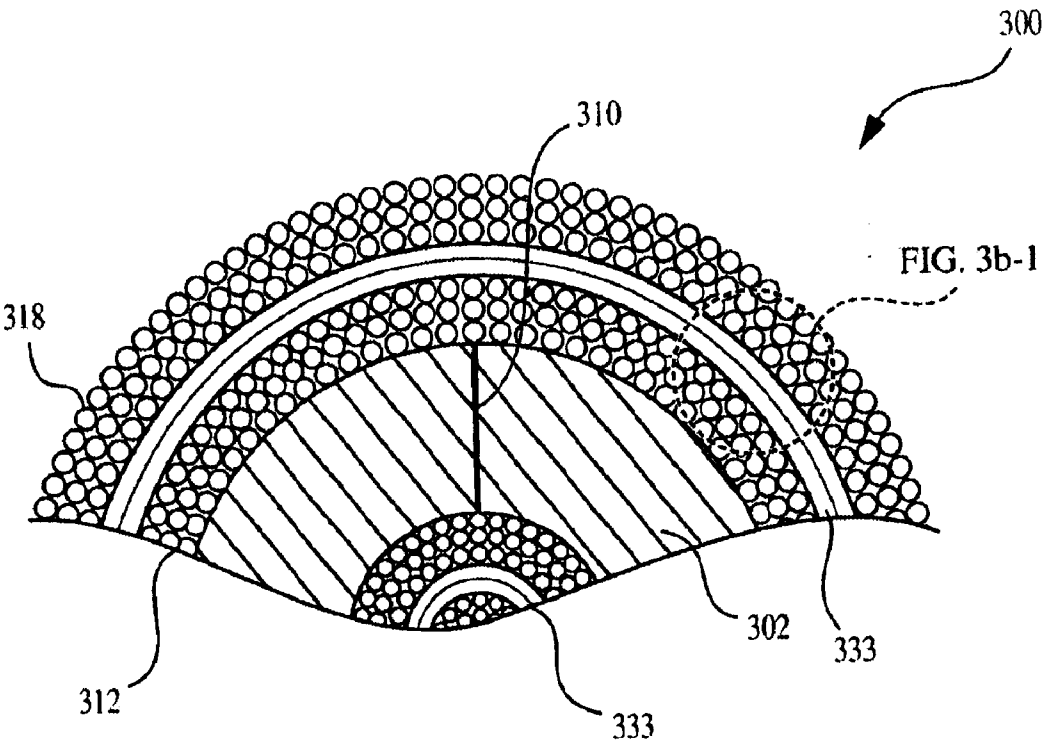
Figure 3C:
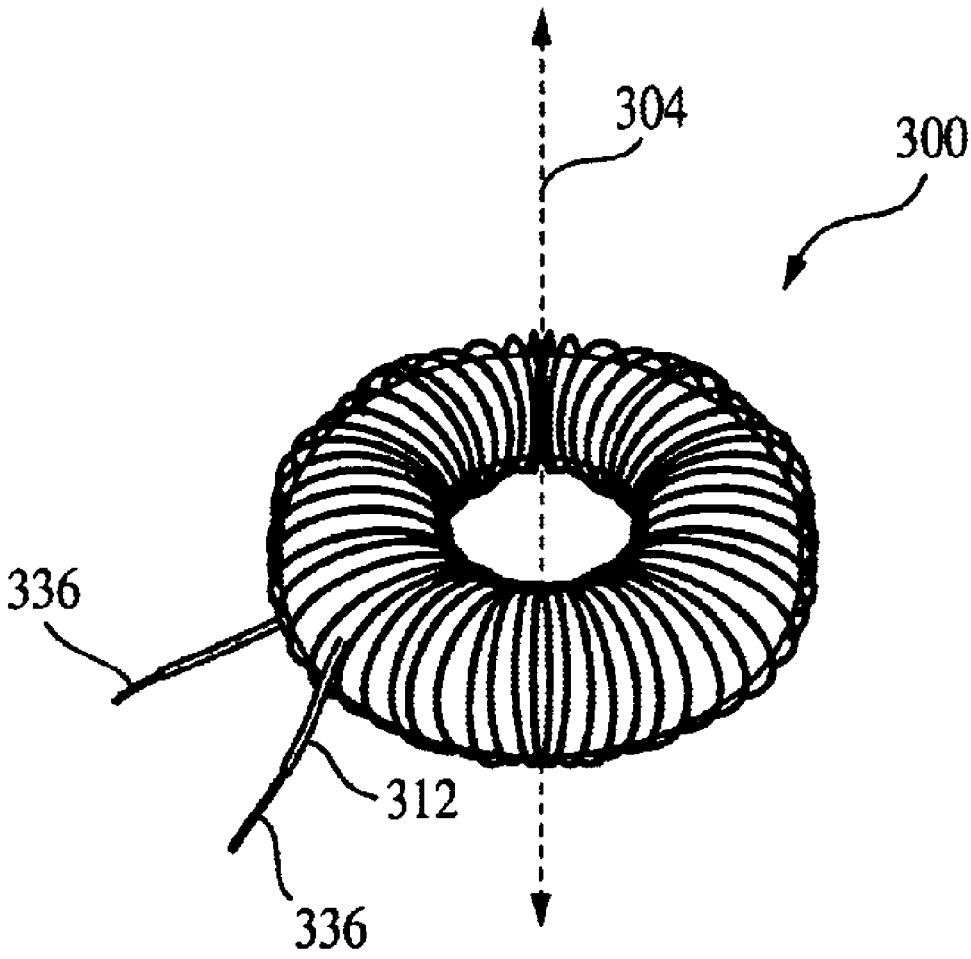
FIG. 3*c* is a perspective view of the exemplary transformer element of FIGS. 3*a*–3*b* (absent the secondary windings), illustrating the polymer coating of the primary winding in greater detail.

Referring now to FIGS. 3*a*–3*c*, a first embodiment of the toroid core device is described. As shown in FIGS. 3*a*–3*c*, the device 300 generally comprises a toroidal or donut-shaped core 302 having substantial symmetry with respect to a central axis 304. The core is fashioned from a magnetically permeable material such as a soft ferrite or powdered iron, as is well known in the electrical arts. The manufacture and composition of such cores is well understood, and accordingly is not described further herein. The core 302 may have a generally rectangular cross-section as does the core shown in FIGS. 3*a*–3*c*, or may alternatively have other cross-sectional shapes including circular, oval, square, polygon, rectangle, and the like.

The core 302 is also optionally provided with a gap 310 formed through the thickness of the core and lying in a radial plane 309 which is generally parallel to the central axis 304. As is well known in transformer construction, the provision of a gap of a high reluctance material (such as air) helps to control the magnetic saturation of the core 302 during transformer operation. In the embodiment of FIGS. 3*a*–3*c*, the gap 310 comprises an air gap formed by cutting the core using a very fine saw, as described in greater detail below with respect to FIG. 10. It can be appreciated, however, that the gap 310 need not be oriented as illustrated (i.e., lying within the aforementioned radial plane), but rather may be skewed. Alternatively, more than one gap may be used, or even one or more partial gaps which do not completely bisect the local region of the core 302 in which they are disposed. As yet another alternative, the gap(s) may be filled with a material having desirable electrical, magnetic, and/or or physical properties, such as in the case of providing a controlled permeability material. In one such alternate embodiment, two gaps could be formed in the core, with one or more of the gaps filled with the aforementioned controlled permeability material mixed with an epoxy, the epoxy providing mechanical rigidity so that the two pieces of the core remain as one integral unit. Many such alternatives are possible, and considered to be within the scope of the invention disclosed herein.

Referring again to FIGS. 3*a*–3*c*, the device 300 also includes a first winding 312 which comprises a fine gauge wire wrapped in a number of turns around the thickness of the core 302. In the present embodiment, "magnet" wire as previously described is selected due to its thin film insulation 334. Hence, for the same number of turns of magnet wire and a comparable conductor having a thicker insulation such as Teflon®, less space is consumed when using the magnet wire. It will be recognized, however, that other types of wire having very thin or "film" insulation may be used consistent with the invention as desired.

A second winding 318 is applied over the top of the first winding 312 in typical transformer winding fashion. This second winding 318 also comprises magnet wire in the illustrated embodiment. In order to overcome the requirement of high dielectric strength (typically 5000 V/mil or higher) between the first and second windings, the present invention advantageously uses one or more layers of insulation 333 which is applied after the first winding 312 is wound onto the core 302, but before the second winding 318 is wound. As illustrated in FIG. 3*b*, these layers of insulation 333 provide the necessary separation between the first and second windings, which may be maintained at significantly different potentials. Additionally, the insulation coating 333 applied to the first winding 312 insulates the winding from other potentials, such as those present on nearby electrical terminals or grounds. The coating in the illustrated embodiment may comprise the well known Parylene polymer (e.g., Parylene C, N, or D manufactured by Special Coating Systems, a Cookson Company, and other companies located in Europe and Asia). Parylene is a thermoplastic polymer that is linear in nature, possesses superior dielectric properties, and has extreme chemical resistance. The Parylene coating is generally colorless and transparent, although colored/opaque varieties may be used. When applied using the vacuum deposition process of the present invention (FIGS. 10 and 11) below, the coating is uniform in thickness, and pinhole free, which advantageously provides the desired high dielectric strength required with minimal coating thickness. The average cured thickness of the Parylene coating in the illustrated embodiment is generally in the range of 1 to 2 mils, although more or less thickness may be used depending on the electrical requirements of the application. FIG. 3*c* illustrates a perspective view of the toroid core 302 with first winding 312 wound thereon, after being coated with the aforementioned Parylene insulation.

It will be apparent to those of ordinary skill in the polymer chemistry arts that any number of different insulating compounds may be used in place of, or even in conjunction with, the Parylene coating described herein. Parylene was chosen for its superior properties and low cost; however, certain applications may dictate the use of other insulating materials. Such materials may be polymers such as Parylene, or alternatively may be other types of polymers such as fluoropolymers (e.g., Teflon, Tefzel), polyethylenes (e.g., XLPE), polyvinylchlorides (PVCs), or conceivably even elastomers (e.g., EPR, EPDM)

Figure 4B:
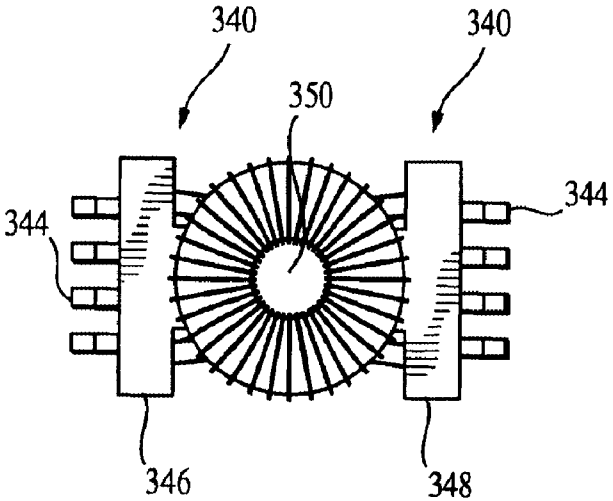
FIGS. 4*a* and 4*b* are perspective and top plan views, respectively, of a first exemplary embodiment of a toroid core transformer package prior to encapsulation.
Figure 4A:
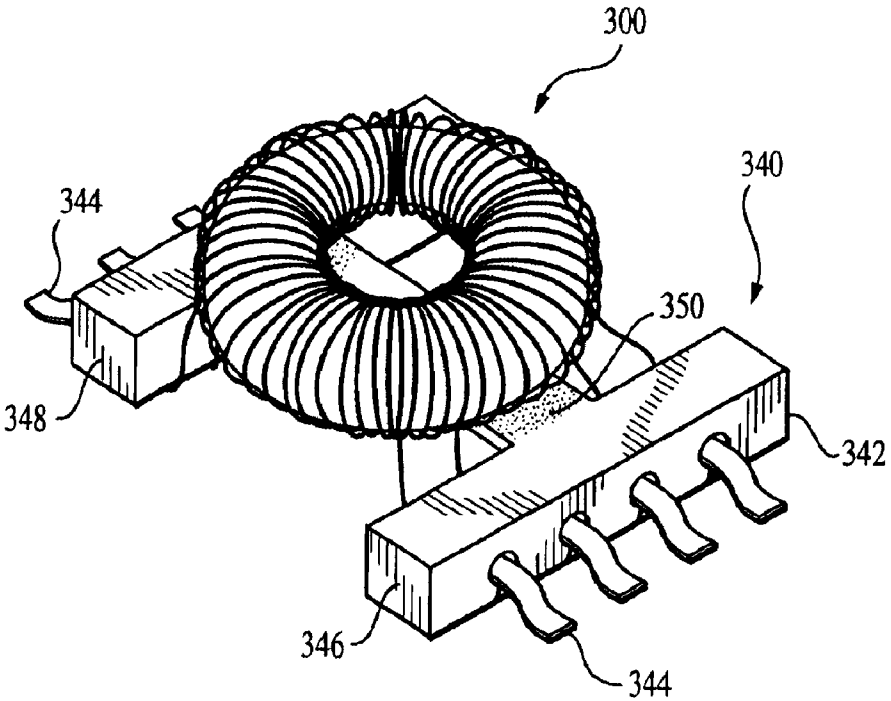

After the second winding 318 is wound onto the device 300 atop the Parylene coating, the free ends 336 of the first and second windings are terminated to a terminal array 340. A first embodiment of the assembled device is illustrated in FIGS. 4*a* and 4*b*. The terminal array 340 comprises an array frame 342, and a plurality of electrically conductive leads or terminals 344. The array frame 342 comprises, in the embodiment of FIGS. 4*a* and 4*b*, an "H" shaped member having two terminal support elements 346, 348 and a crossbar element 350. The two terminal support elements 346, 348 are arranged generally in parallel, although other configurations may be used depending on the location of the corresponding terminal pads on the substrate (e.g., PCB) to which the device will be mated. The terminals 344 are embedded into the support elements 346, 348 so as to be rigidly retained therein, as well as align with the aforementioned terminal pads of the substrate. While the terminals 344 of the illustrated embodiment comprise the well known "L" shape adapted for surface mounting to a substrate, it will be recognized that other pin configurations may be used as well, including balls (such as in the well known ball grid array or micro-ball grid array approaches) or pins (such as used in pin grid arrays).

The crossbar element 350 of the embodiment of FIG. 4*a* both retains the relative positions of the support elements 346, 348, and acts as a support for the toroidal core 302 (and windings) when the device is assembled as shown in FIG. 4*a*. The array frame 342 of FIG. 4*a* is advantageously formed from a polymer (e.g., plastic) for both low cost/ease of manufacturing and high strength, although other types of materials may conceivably be used.

Figure 4C:
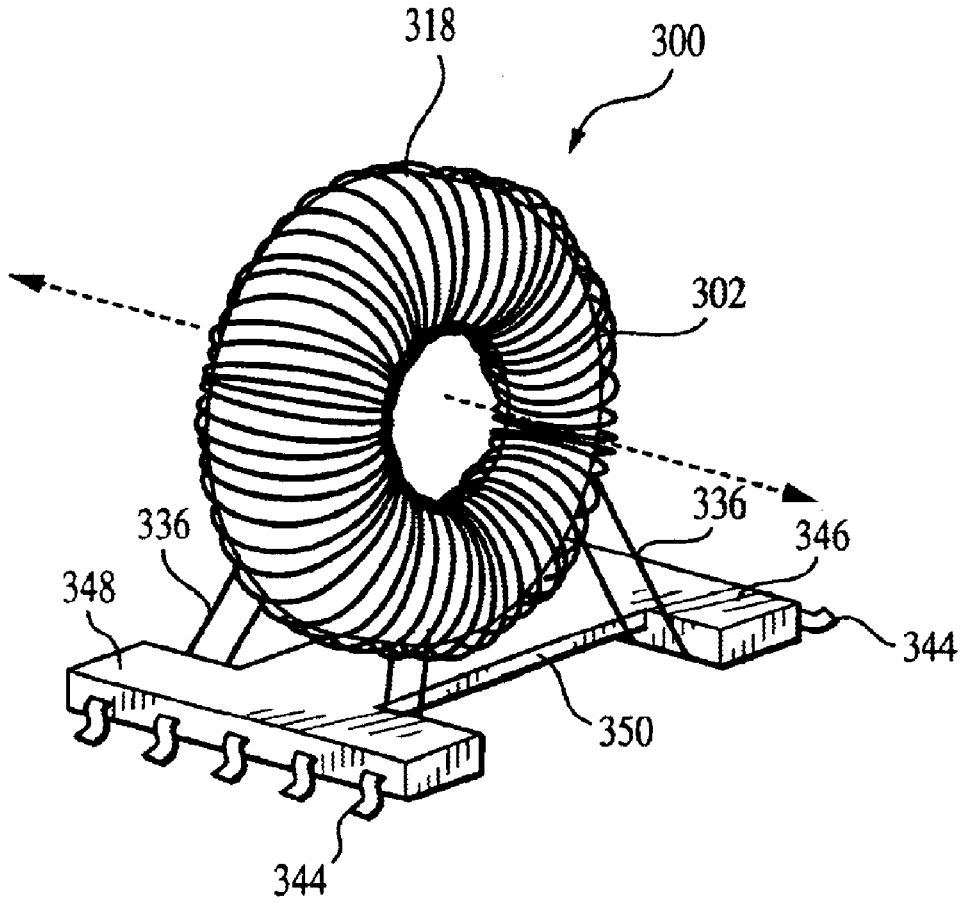
FIG. 4*c* is a perspective view of a second exemplary embodiment of a toroid core transformer package prior to encapsulation.

When the device is assembled as shown in the second embodiment of FIG. 4*c*, the core 302 is oriented with its central axis 304 parallel to the plane of the support elements 346, 348 (and ultimately the substrate, not shown), and disposed atop the crossbar element 350. Hence, in the present embodiment, the core can be thought of as "standing on end" atop the crossbar 350. This orientation is used to minimize the footprint of the device, and allow the terminal array frame 342 to be sized as small as possible. The core 302 (with windings) can be attached to the crossbar 350 using an adhesive (not shown). It can be appreciated, however, that yet other methods of securing the core 302 and windings 312, 318 with respect to the terminal array 340 may be used if desired. For example, if an encapsulant (such as an epoxy over-molding) is applied to the device, such encapsulant would secure or "freeze" the position of the core and windings relative to the terminal array 340. As yet another alternative, the core 302 can be un-encapsulated and essentially "free floating" with respect to the terminal array 340 if desired, such as when no tension or pre-load is placed on the free ends 336 of the windings when the latter are bonded to the terminals 344 of the array 340.

Figure 5B:
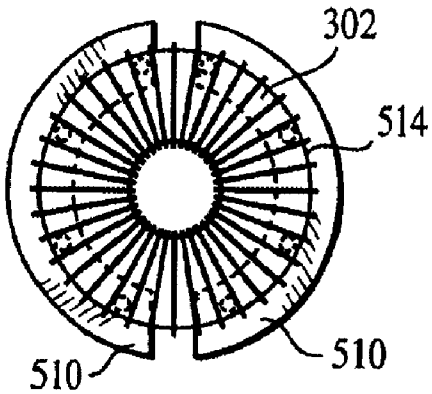
FIGS. 5*a* and 5*b* are perspective and top plan views, respectively, of a third exemplary embodiment of a toroid core transformer package prior to encapsulation.
Figure 5A:
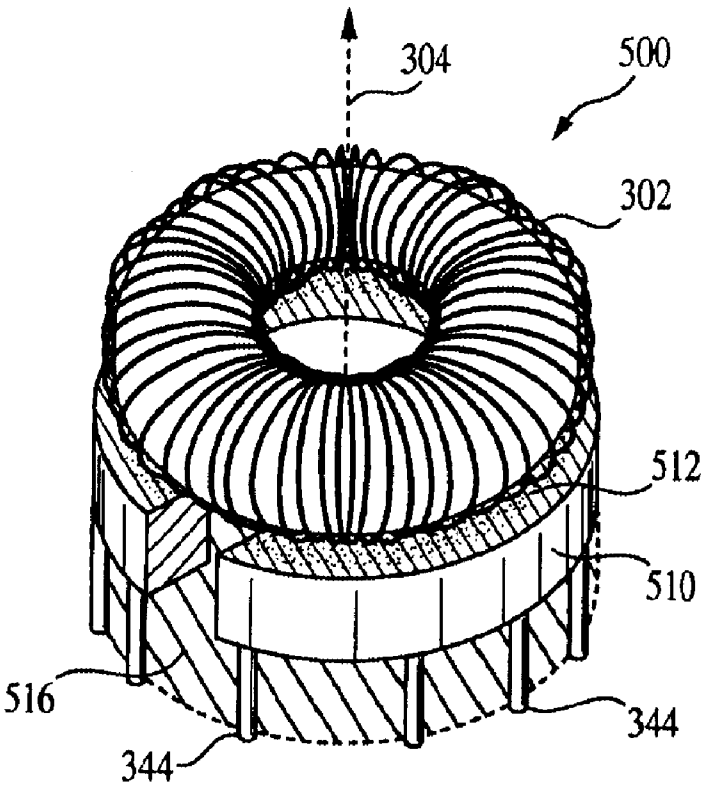

FIGS. 5*a* and 5*b* illustrate a third embodiment of the toroidal core device of the present invention. In this embodiment, the device 500 comprises the core 302 (with windings and insulating coating) which is mounted to a semi-circular terminal array 510 using an adhesive 512. The core 302 is oriented such that its central axis 304 is vertical or normal to the plane of the terminal array 510 and the substrate when device is installed thereon (not shown). The shape of the terminal array 510 is adapted to conform substantially to the outer circumference 514 of the core 302, such that the device occupies a substantially circular footprint 516 on the substrate to which it is mounted (FIG. 5*b*).

Figure 6:
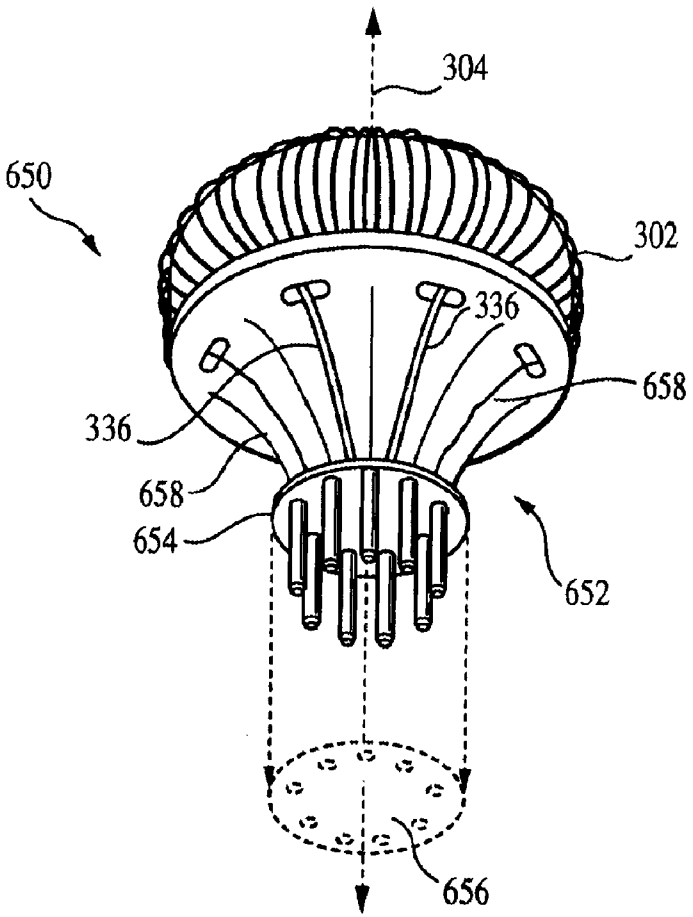
FIG. 6 is a perspective view of a fourth exemplary embodiment of a toroid core transformer package prior to encapsulation.

FIG. 6 illustrates a fourth embodiment of the toroidal core device of the present invention. In the embodiment of FIG. 6, the device 650 comprises the core 302 (with winding and insulating coating) which is mounted to a terminal array 652, the latter having a substantial vertical height above the substrate (not shown) to which the device is mated. This comparatively large vertical height is coupled with the use of a very small profile lower terminal array 654 which has a minimal footprint 656. Hence, the toroid core 302 is suspended at an elevation well above the substrate, and the free ends of the windings 336 disposed in channels 658 formed in the outer periphery of the terminal array 652 such that electrical separation and mating of the windings to their respective terminals 660 is readily accomplished. If desired, the free ends 336 of the windings are coated with the insulation material as previously along their entire length to provide additional dielectric strength. As with the embodiments of FIGS. 4*a*–4*c* and 5, the device of FIG. 6 may optionally be encapsulated if desired.

While the foregoing embodiments illustrate various configurations for supporting and terminating the toroid core of the present invention, it will be recognized that myriad other configurations may be utilized, dependent on the needs of the particular application. Hence, the embodiments of FIGS. 4*a*–6 are merely exemplary in nature.

Figure 7:
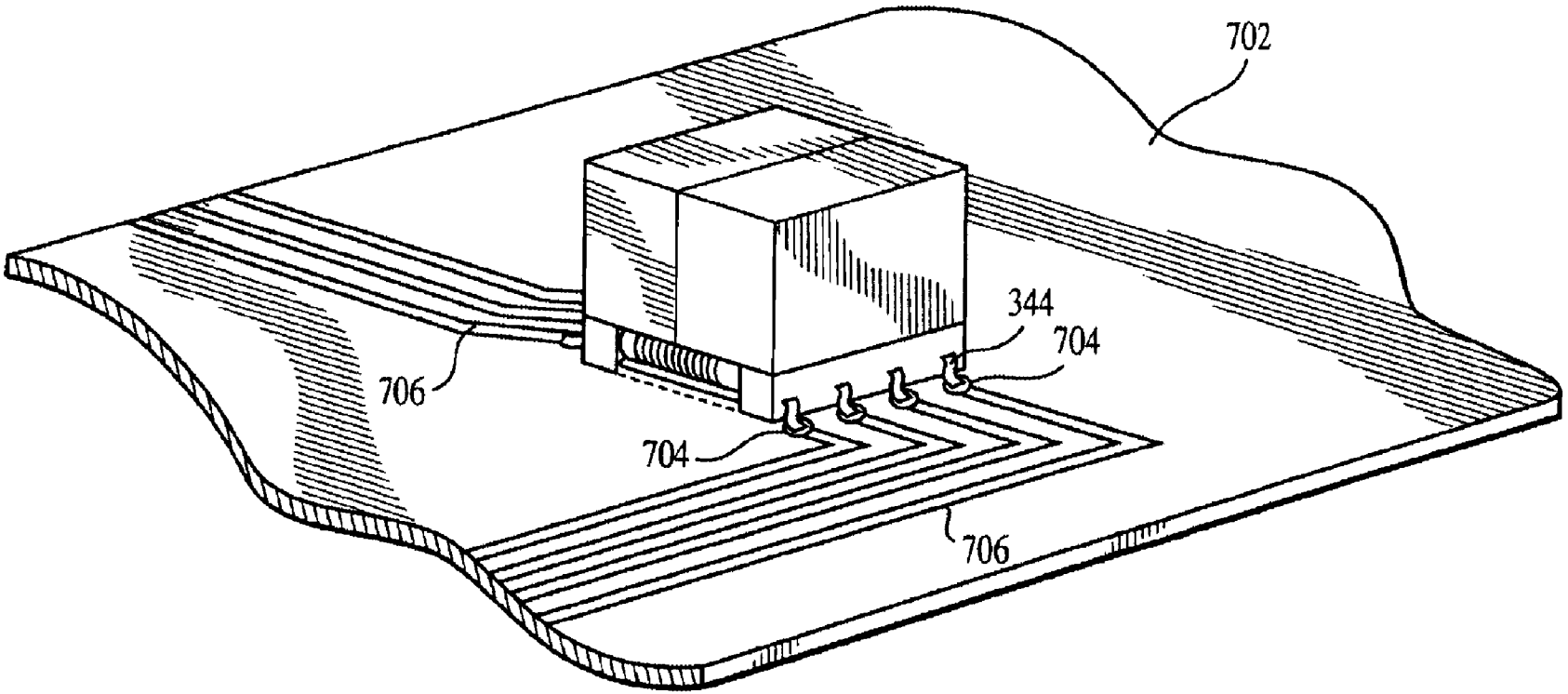
FIG. 7 is a perspective view of the toroid core transformer of FIGS. 4*a*–4*b* after encapsulation, and mounted on a typical substrate (PCB) to form a circuit board assembly.

Referring now to FIG. 7, the device 300 of FIGS. 4*a*–4*b* is shown after encapsulation using an epoxy encapsulant of the type well known in the art, and mounting on a printed circuit board (PCB) 702 having a plurality of conductive pads 704 and traces 706. As shown in FIG. 7, a plurality of devices may be disposed on the PCB if desired. The device 300 is mounted to the conductive pads 704 of the PCB using a surface mount technique involving reflow soldering of the terminals 344 of the device to the pads 704, although other techniques may be used. In the present embodiment, a standard eutectic solder (such as 63% lead and 37% tin) is used to establish a permanent bond between the terminals 344 of the array and the pads 704 of the board, although other bonding agents may be used. The device may also be mounted on the PCB using a component carrier or secondary substrate (not shown) if desired, as is also well known in the art. Furthermore, it will be recognized that other types of mounting arrangements may be utilized, such as those having a substrate with perforations through its thickness for receiving the terminal pins 344 of the device therein (commonly referred to as a pin-grid array or PGA), such terminals subsequently being bonded using a wave or dip solder process. Many other arrangements are possible, all being considered to be within the scope of the invention disclosed herein.

Figure 8:
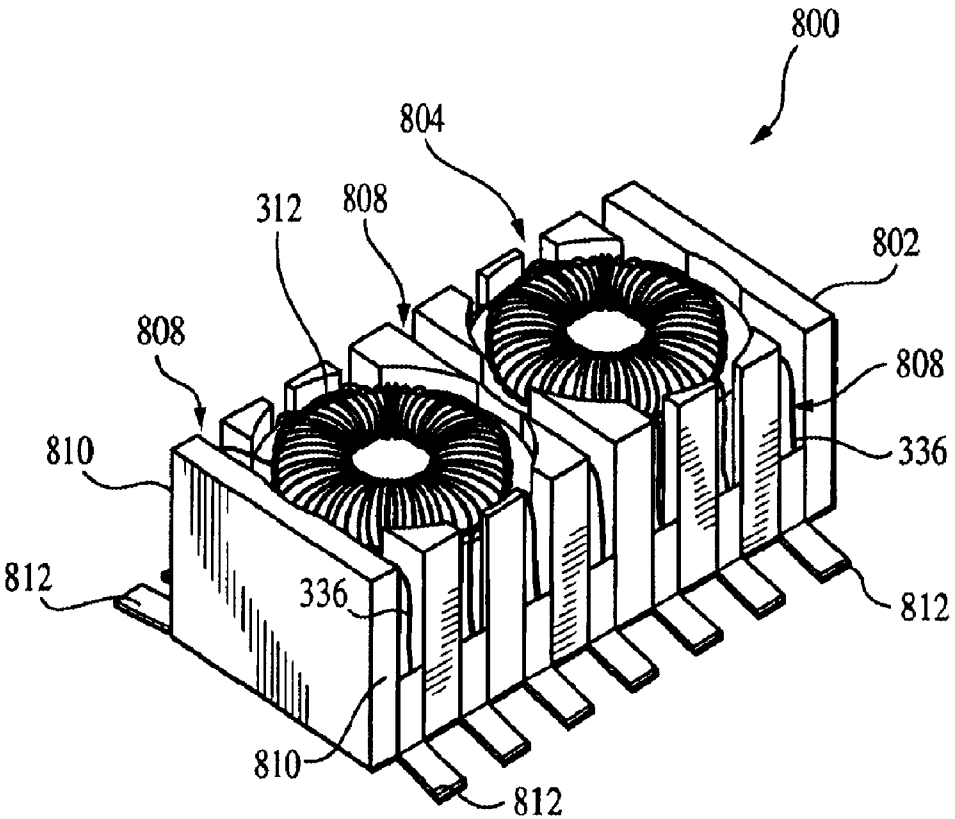
FIG. 8 is a perspective view of a plurality of toroid core devices according to the present invention disposed within an interlock base device.

FIG. 8 illustrates yet another embodiment of the invention, wherein a plurality of toroid core devices 300 are disposed within a nonconductive support base or carrier 802 to form a component package 800. In the illustrated embodiment, the support base 802 comprises a so-called "interlock base" of the type well known in the art. U.S. Pat. No. 5,015,981 entitled "Electronic Microminiature Packaging and Method" issued May 14, 1991, and assigned to the Assignee hereof, which is incorporated by reference herein in its entirety, describes the construction and fabrication of such interlock base devices in detail. The non-conducting support base 802 includes a plurality of recesses 804 formed in the central portion 806 of the base 802, as well as a plurality of lead channels 808 formed in the sidewall areas 810 of the base. The lead channels 808 are adapted to receive both the free ends 336 of the windings of the toroid core device 300, as well as electrical leads 812 (typically in the form of a common leadframe; not shown); the electrical leads 812 ultimately mate with the conductive pads 704 of the PCB or other substrate to which the package 800 is mounted, and form a conductive path there from through the windings 312, 318 and out through other ones of the leads and conductive pads. The leads 812 and the free ends 336 of the windings 312, 318 are held in electrical contact with one another by frictional forces generated on the leads 812 when they are received within the channels 808, and also may optionally be soldered if desired.

The support base 802 is preferably constructed of a suitable molded non-conducting material; for example, a high temperature liquid crystal polymer such as that available under the part number RTP 3407-4 from the RTP Company of Winona, Minn. may be used. It will be recognized, however, that a variety of other insulative materials may be used to form the base element, depending on the needs of the, specific application.

Note that in the present embodiment, the free ends 336 of the windings are coated using the insulation material as previously described almost their total length, including a portion of the length of the channel 808 in which each free end 336 resides, thereby providing additional electrical separation from other components. The package 800 may also be optionally encapsulated if desired, as described above.

Figure 9:
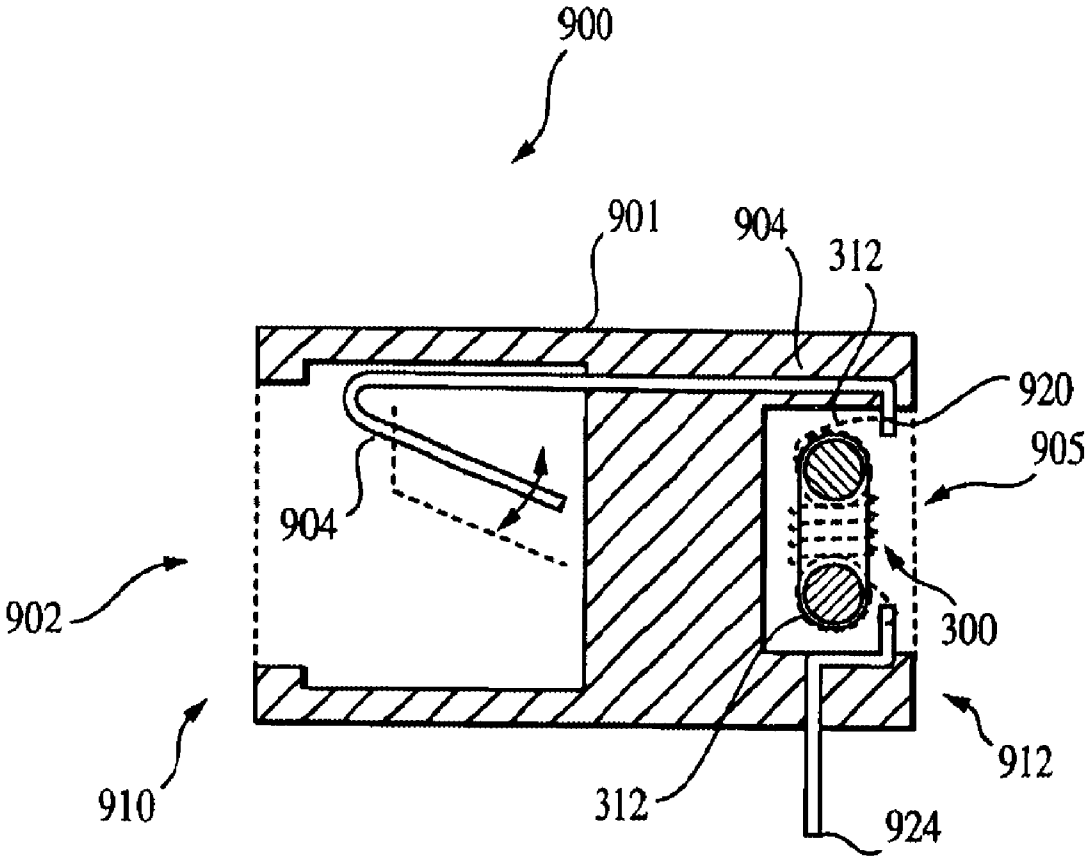
FIG. 9 is a rear perspective view of the toroid core transformer of the present invention, disposed within the component recess of an RJ-45 connector.

FIG. 9 illustrates yet another embodiment of the invention, wherein the toroid core device 300 is disposed within an RJ type connector of the type well known in the art. In the embodiment illustrated in FIG. 9, the connector 900 comprises a connector body 901 having a receptacle 902 formed therein, the receptacle having a plurality of electrical contacts 904 for mating with the contacts of a modular plug received within the receptacle (not shown), a cavity 905 disposed within the body 901, and at least one toroid element device 302 having a plurality of windings 312, 318 of the type previously described disposed with the cavity 905. In the illustrated embodiment, the receptacle 902 and cavity 904 are disposed at the front end 910 and back end 912 of the connector body 901, respectively, although it will be appreciated that any number of different arrangements (such as the cavity 904 being disposed on the top, bottom, or sides of the connector body 901) may be used if desired. One set of windings of the toroid is conductively coupled to the terminals 920 of the aforementioned electrical contacts 904 (such as by soldering and/or winding around a notch in the terminal), thereby forming a conductive pathway from the contacts of the modular plug through the contacts 904 of the connector and terminals 920 of the connector and through the windings 312 of the toroid element. A set of electrical leads 924 connecting the second set of toroid windings to an external device (such as a PCB; not shown) are also provided. Hence, in the illustrated configuration, and where the toroid device 300 is chosen to be a transformer, the signal input via the modular plug received within the receptacle 902 of the connector 900 is transformed in voltage by the toroid device 300, and the transformed signal communicated to the PCB or external device via the electrical leads 924. The cavity 905 of the connector is optionally filled with an epoxy or other encapsulant if desired, thereby retaining the device 300 in position.

It will be recognized that any number of different connector configurations and methods of termination may be used in conjunction with the toroid core device of the present invention. For example, a connector configuration having a miniature PCB disposed in the connector body may be used to mount and terminate the device 300. Alternatively, a two-piece connector of the type disclosed in U.S. patent application Ser. No. 09/169,842 entitled "Two Piece Microelectronic Connector and Method" filed Oct. 9, 1998, and assigned to the Assignee hereof, and which is incorporated herein by reference in its entirety, may be used in conjunction with the toroid device 300 of the invention.

Method of Manufacture

Figure 10:
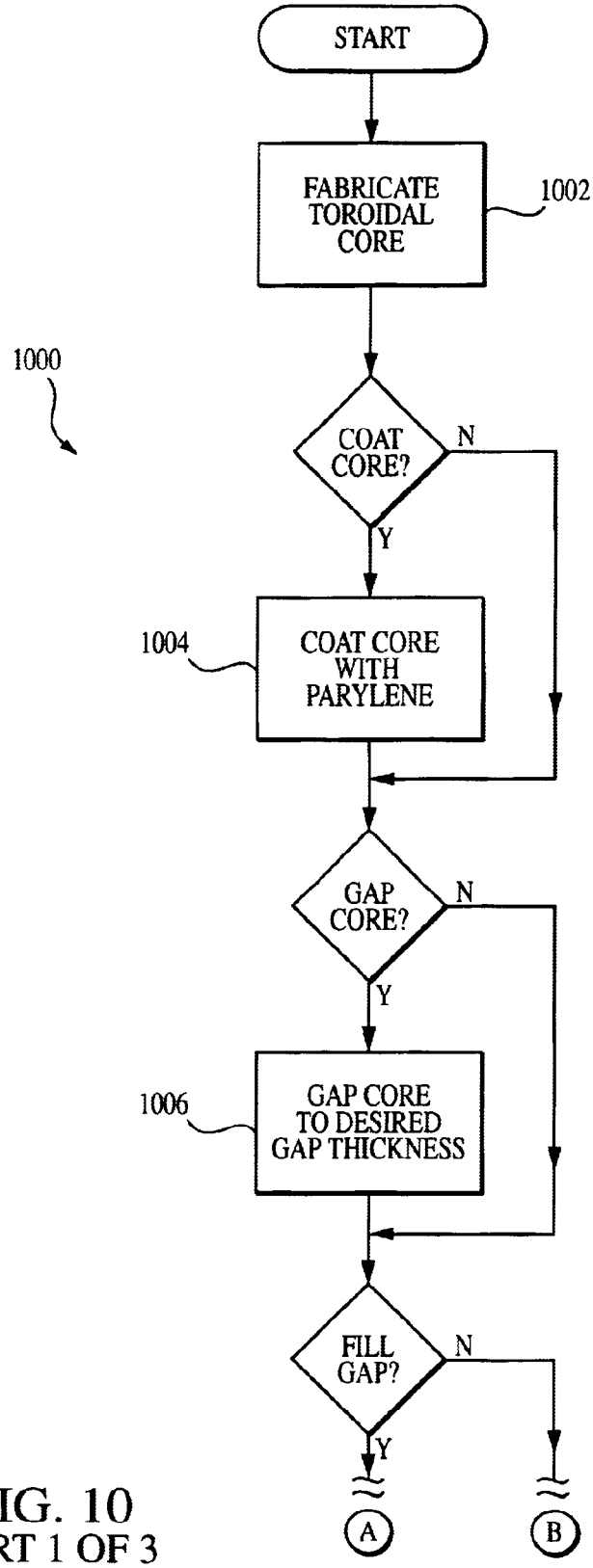
FIG. 10 is a logical flow diagram illustrating one exemplary embodiment of the manufacturing process of the present invention
Figure 10:
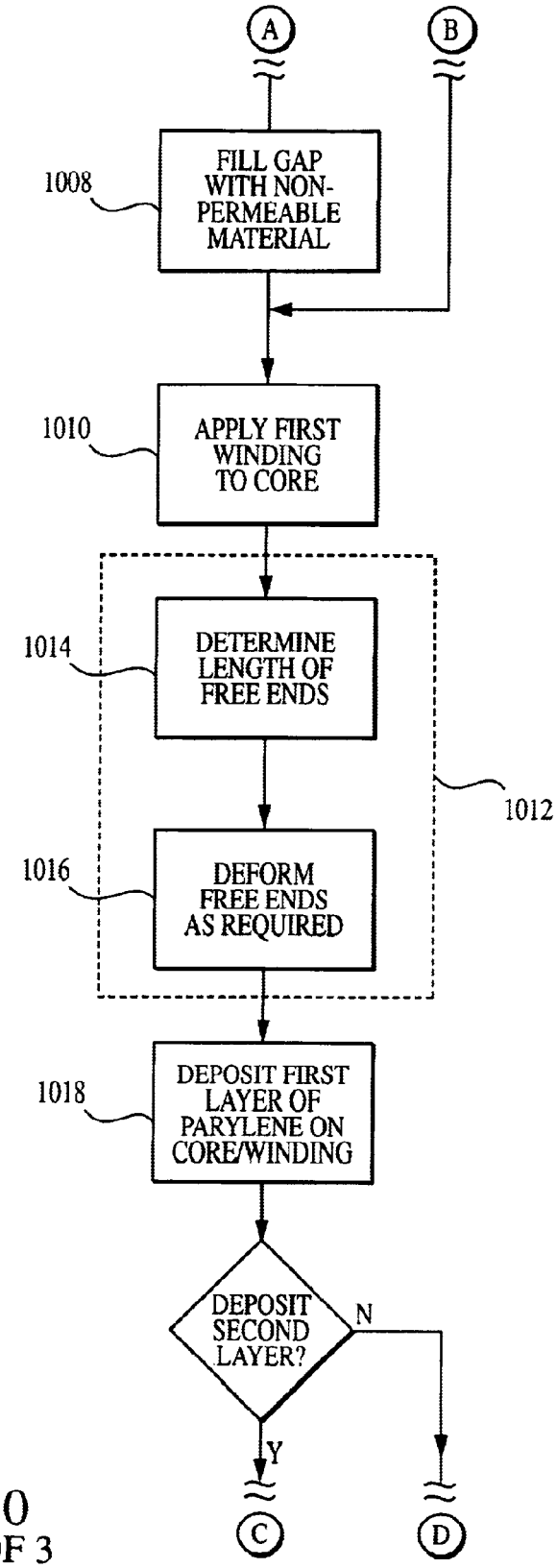
Figure 10:
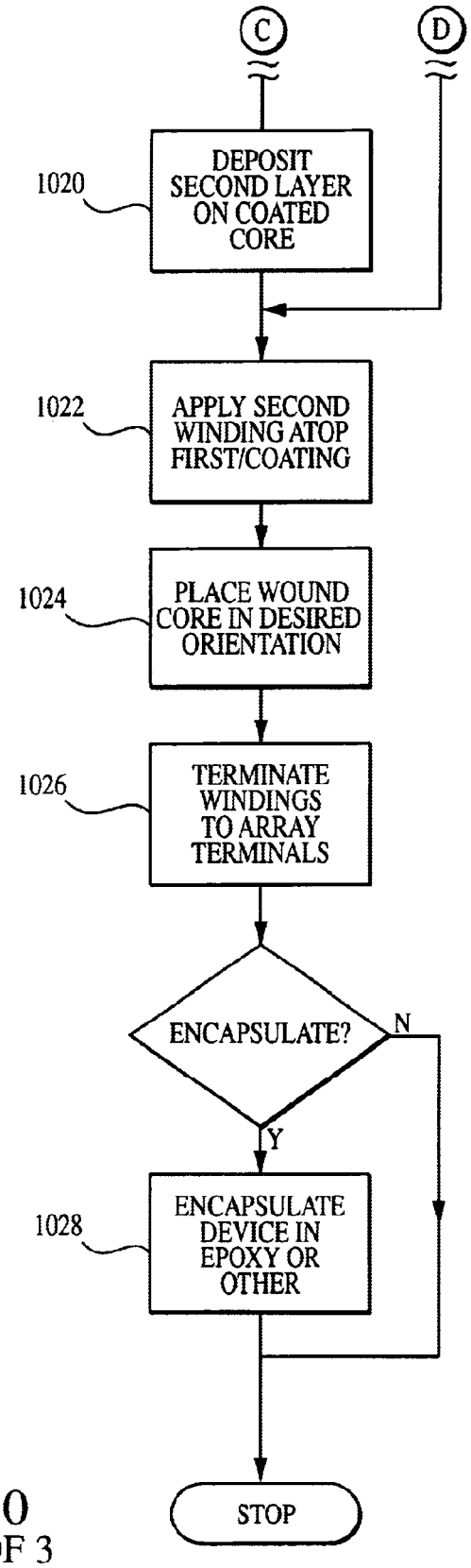
Figure 11:
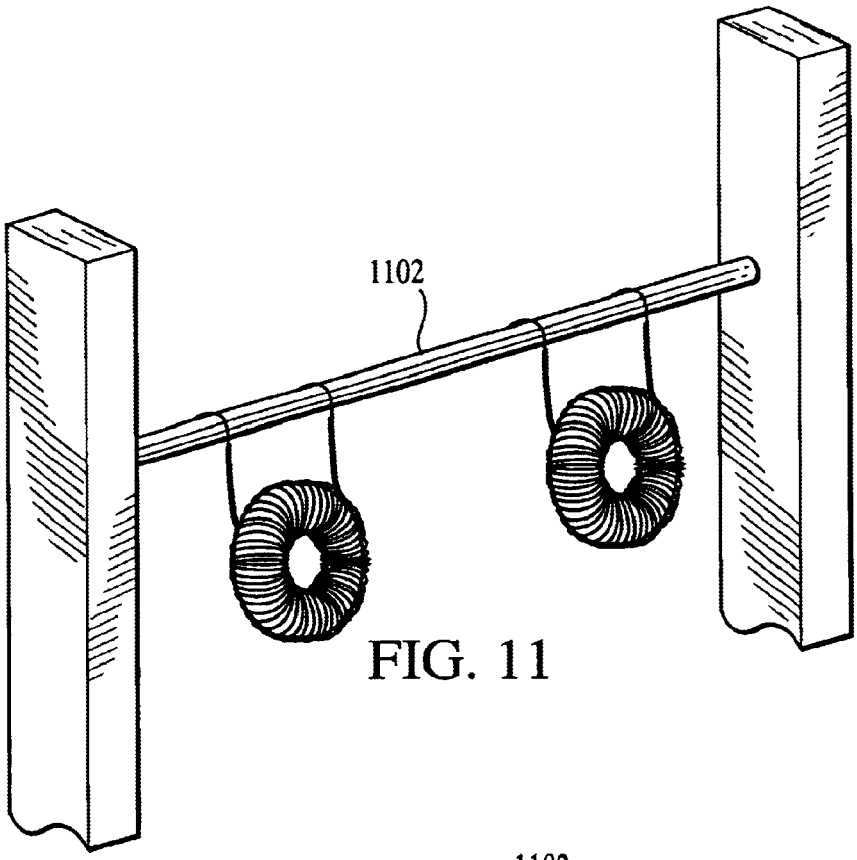
FIG. 11 is a perspective view of the manufacturing apparatus and arrangement of the invention, used for applying the polymer insulation to the toroid core devices.

Referring now to FIGS. 10 and 11, a method 1000 of manufacturing the aforementioned microelectronic toroidal coil package is described in detail.

In the first step 1002, a toroid core is fabricated. The toroidal core 302 of the exemplary transformer is formed from a magnetically permeable material using any number of well understood processes such as material preparation, pressing, and sintering, The core is optionally coated with a layer of polymer insulation (e.g., Parylene) in step 1004, so as to protect the first set of windings from damage or abrasion. This coating may be particularly useful when using very fine gauge windings or windings with very thin film coatings that are easily abraded during the winding process. The core is also optionally gapped to the desired gap thickness in step 1006 using a micro-saw technique whereby the gap 310 is created radially through the thickness of the core. Alternatively, the gap may be formed using any one of a multitude of other techniques, such as pre-forming the gap when the core is formed, or even using laser energy to cut the gap into the core.

Since the core 302 is symmetric radially in all directions around the central axis 304 of the core, the angular location of the gap 310 is not critical. Alternatively, a plurality of gaps may be created in the core as previously described. The gap(s) 310 may also optionally be filled with a non-permeable or partially permeable material as desired in step 1008 in order to preclude the windings from being caught in the gap (and potentially damaged by the edges of the core at the gap) during winding, or provide the core 302 with other desirable properties such as enhanced rigidity.

In step 1010, the first winding of the device is applied using, for example, a toroid core winding machine of the type well known in the manufacturing arts. Alternatively, the device may be hand-wound, or yet other processes used. As previously described, so-called "magnet wire" is commonly used as the first winding of toroid core transformers, and is advantageously selected in the embodiment of FIG. 3 herein due to its small cross-sectional profile.

Next, the core with first winding attached is prepared for deposition of the insulating layer(s) in step 1012. Specifically, the desired coverage or extent of the insulating material on the free ends of the leads is determined in step 1014. This value is dictated largely by the design attributes of the device (e.g., the distance between the windings and terminal array, required dielectric strength, requirements of safety agencies such as UL, etc.). Once the length of coverage on the free ends is determined, the free ends of the windings are deformed in a predetermined pattern in step 1016 so that the cores may be hung from a support member 1102 (FIG. 11), and exposing the portion of the windings to be coated 1104 to the deposition process. The predetermined pattern may be a simple "J" or "U" shaped hook, a spiral, a circle, a sharp bend, or literally any other shape which facilitates support of the device by the support member. The devices are then hung within the vacuum deposition chamber from the support member as shown in FIG. 11.

Note that in one alternate embodiment, the free ends of the winding may be inserted into deformable material (such as a putty or silicone), thereby obviating the aforementioned step of bending. The friction of the free ends of the windings within the putty holds or suspends the devices in place, while preventing coating of that portion of the winding conductors embedded within the putty or silicone. It will be appreciated that any variety of different methods for maintaining the device(s) in place during coating may be substituted.

Next, in step 1018, the vacuum deposition chamber is used to deposit a first layer of insulating material (such as the Parylene compound previously described) on the first winding, exposed portions of the core, and exposed portions of the free ends of the first winding. A vacuum deposition process is chosen in the present embodiment based on its ready availability, ease of use, and highly controllable deposition process. Specifically, using vacuum deposition, the thickness of the insulating material being deposited on the device can be tightly controlled, such that a largely uniform coating thickness is achieved. This attribute is highly desirable in the present application, since a difference of a few fractions of a mil in insulation thickness in certain locations may result in the device failing prematurely or not passing its electrical performance tests. From a manufacturing standpoint, minimizing the number of devices that fail testing due to uncontrolled variations in insulation layer thickness leads to greater throughput and reduced device unit costs.

Since portions of the free ends are either in contact with the support member, or otherwise obscured (such as being inserted within the aforementioned putty) during the vacuum deposition process, these portions will not be coated. Hence, by carefully controlling the location at which the bend (or other method of suspension) occurs along the length of the free end(s), the coverage of the insulating material can be precisely controlled, thereby obviating separate manufacturing steps for stripping insulation from the free ends for termination to the terminal array.

Alternatively, excess insulation present on the free ends of the windings may be stripped during soldering, as is well known in the art.

After the first layer of insulating material has polymerized (or while it is polymerizing), a second layer of insulation is optionally added atop the first in step 1020 using the same deposition process. Third and subsequent layers may also be deposited if required. Note also that as previously described, different insulating materials may be used for the first and subsequent layers. For example, Parylene could be used as the first layer, while a fluoropolymer (such as Teflon® or Tefzel®) could constitute the second layer. Many such combinations of materials comprising the first and subsequent insulation layers are possible, all being within the knowledge of one of ordinary skill in the polymer chemistry arts.

After the insulating material has been deposited, the core and first winding, including the majority of the free ends of the winding, are coated and ready for the application of the second winding per step 1022. A coating of other insulating material may be optionally applied as well to add to the mechanical strength of the insulation system. The second winding is applied using techniques similar to that by which the first winding was applied. The core with second winding attached may then be coated using the aforementioned vacuum deposition process or other insulating material if desired, although if the thickness and coverage of the first layer(s) of insulation are sufficient, such second layer of insulating material is not required, and tends only to increase the size of the finished device. Advantageously, since the first layer of insulation covers the free ends of the first winding in a complete and controlled fashion, electrical separation between the first winding and any others present on the transformer is maintained without any other insulation being applied, including in the area of the terminal array.

It will be recognized that additional windings may subsequently be applied to the core of the device as desired. For example, in the case of a transformer with a primary and two secondary windings, three distinct windings would be applied to the core. All such windings may or may not be separated by insulation layers such as those previously described herein, dependent upon the dielectric strength requirements between each of the separate windings.

Next, in step 1024, the coated and wound device is placed in the desired orientation with respect to the terminal array as illustrated in FIGS. 4*a* and 4*b*. Ideally, the orientation is selected to provide the smallest footprint for the device, although other considerations may dictate one configuration or another, such as for example those of FIGS. 4*c*, 5*a*–5*b*, or 6.

The free ends of the first and second winding conductors are then terminated to the terminal array in step 1026. Termination of these conductors is accomplished in the present embodiment using a soldering process of the type well known in the art (e.g., dip soldering, wave soldering, etc.), although other methods of bonding including frictional bonding, or even fusion using laser energy may be substituted. An adhesive may also be optionally applied when situating the core on the terminal array (step 1024) in order to assist in maintaining the position of the core with respect to the array during soldering.

After the windings have been terminated in step 1026, the device is optionally encapsulated in step 1028 using a polymer or epoxy encapsulant, or other packaging technology as desired.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A microelectronic toroidal circuit element comprising:

a toroidal core, at least a portion of said core comprising a magnetically permeable material;

a first conductive winding having a plurality of turns, at least a portion of said first winding being disposed around said core;

at least one layer of insulating material coating at least a portion of said first winding; and a second conductive winding having a plurality of turns, at least a portion of said second winding being disposed around said core and atop said at least one layer of insulating material.

2. The circuit element of claim 1, further comprising at least one gap formed within said toroidal core.

3. The circuit element of claim 1, wherein said first conductive winding comprises a conductor having at least one film coating disposed on at least a portion of its surface.

4. The circuit element of claim 2, wherein said insulating material comprises Parylene.

5. The circuit element of claim 1, wherein said at least one layer of insulating material is deposited in a substantially uniform thickness via a vacuum deposition process.

6. The circuit element of claim 5, wherein said at least one layer of insulating material comprises a first and second layer of insulting material, said first layer being deposited on said first winding, said second layer being deposited on said first layer after said first layer has substantially polymerized.

7. The circuit element of claim 6, further comprising a third layer of insulating material, said third layer being formed atop at least a portion of the surface of said core and between said core and said first winding using a deposition process.

8. The circuit element of claim 2, wherein said at least one gap is at least partially filled with a material having a magnetic reluctance higher than that of said toroidal core.

9. The circuit element of claim 4, wherein said Parylene is deposited along at least a portion of the free ends of at least said first winding.

10. The circuit element of claim 1, further comprising:

at least one layer of insulating material formed atop at least a portion of said second winding; and a third winding having a plurality of turns, at least a portion of said third winding being disposed around said core and atop said at least one layer formed atop said second winding.

11. A microelectronic component package comprising:

an insulating base having at least one recess formed therein;

at least one substantially toroidal magnetically permeable core having at least one gap formed therein;

a first winding wound at least in part around said at least one core, said first winding having a first and second end;

at least one layer of insulation material coating at least a portion of said first winding;

a second winding wound at least in part around said at least one core and atop at least a portion of said at least one layer of insulation material, said second winding having a first and second end; and a terminal array comprising a plurality of electrically conductive terminals, said terminal array in fixed relationship with said insulating base;

wherein said at least one core is disposed at least partly within a corresponding one of said at least one recess, and said first and second ends of said first and second windings are in electrical communication with respective ones of said terminals.

12. A microelectronic toroidal circuit element comprising:

a unitary toroidal core, at least a portion of said core comprising a magnetically permeable material;

a first conductive winding having a plurality of turns, at least a portion of said first winding being disposed around said core;

at least one substantially uniform layer of insulating material adherently coating at least a portion of said first winding; and a second conductive winding having a plurality of turns, at least a portion of said second winding being disposed around said core and atop said at least one layer of insulating material;

wherein said adherent coating by said at least one substantially uniform layer permits said circuit element to be smaller in size than would otherwise be achievable using a tape layer.

13. The circuit element of claim 12, wherein said first conductive winding further comprises at least first and second rows of said turns, said second row being disposed substantially atop said first row.

14. A toroidal circuit element being optimized for space conservation, comprising:

a unitary toroidal core, at least a portion of said core comprising a magnetically permeable material;

a first conductive winding having a plurality of turns and comprising a fine-gauge wire having a film coating of insulation, said first conductive winding being disposed around said core in a high spatial density;

at least one layer of insulating material coating at least a portion of said first winding, wherein said at least one layer of insulating material has a substantially uniform thickness; and a second conductive winding having a plurality of turns, at least a portion of said second winding being disposed around said core and atop said at least one layer of insulating material;

wherein said fine gauge wire, film coating, and at least one layer of insulating material cooperate to minimize the volume consumed by said circuit element.

15. The circuit element of claim 14, wherein said first conductive winding further comprises at least first and second rows of said turns, said second row being disposed substantially atop said first row.

16. The circuit element of claim 15, wherein said fine-gauge wire comprises magnet wire.

17. A high-withstand voltage microelectronic toroidal circuit element, comprising:

a unitary toroidal core, at least a portion of said core comprising a magnetically permeable material;

a first conductive winding having a plurality of turns, at least a portion of said primary winding having at least a thin film layer of dielectric material, at least a portion of said first winding being disposed around said core;

at least one unitized layer of insulating material coating at least a portion of said first winding, wherein said at least one layer of insulating material has a substantially uniform and controlled thickness; and a second conductive winding having a plurality of turns, at least a portion of said second winding having a thin film layer of dielectric material and being disposed around said core and atop said at least one layer of insulating material;

wherein at least said thin film layers and said at least one layer of insulating material cooperate to provide said circuit element with both a high dielectric strength and high spatial density.

18. A high-withstand voltage, space optimized toroidal circuit element, comprising:

a unitary toroidal core, at least a portion of said core comprising a magnetically permeable material, said core having at last one gap formed therein and an outer surface;

a first unitized layer of insulating material deposited on said outer surface having a substantially uniform thickness;

a first conductive winding having a plurality of turns and at least a thin film layer of dielectric material, at least a portion of said first winding being disposed around said core in high spatial density wherein at least two rows of said turns are formed, a second of said two rows being disposed atop a first of said two rows;

a second unitized layer of insulating material coating at least a portion of said first winding, wherein said second layer of insulating material has a substantially uniform thickness; and a second conductive winding having a plurality of turns, at least a portion of said second winding having a thin film layer and being disposed around said core and atop said at least one layer of insulating material;

wherein at least said thin film layers and said first layer of insulating material cooperate to provide said circuit element with both a high dielectric strength and high spatial density.

* * * * *

UNITED STATES PATENT AND TRADEMARK OFFICE

CERTIFICATE OF CORRECTION

PATENT NO. : 6,642,827 B1
DATED : November 4, 2003
INVENTOR(S) : Michael D. McWilliams et al.

Figure 12:
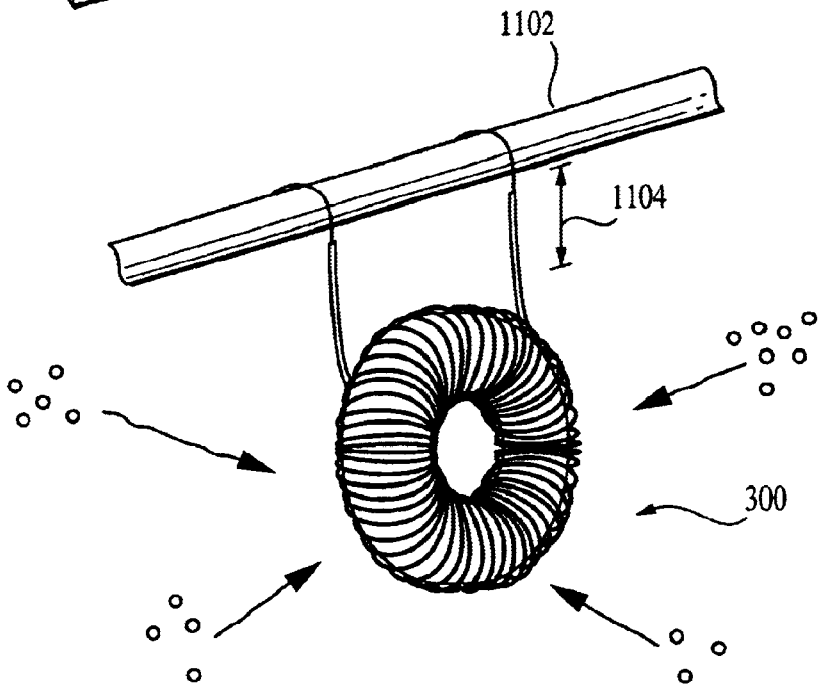
Figure 11:
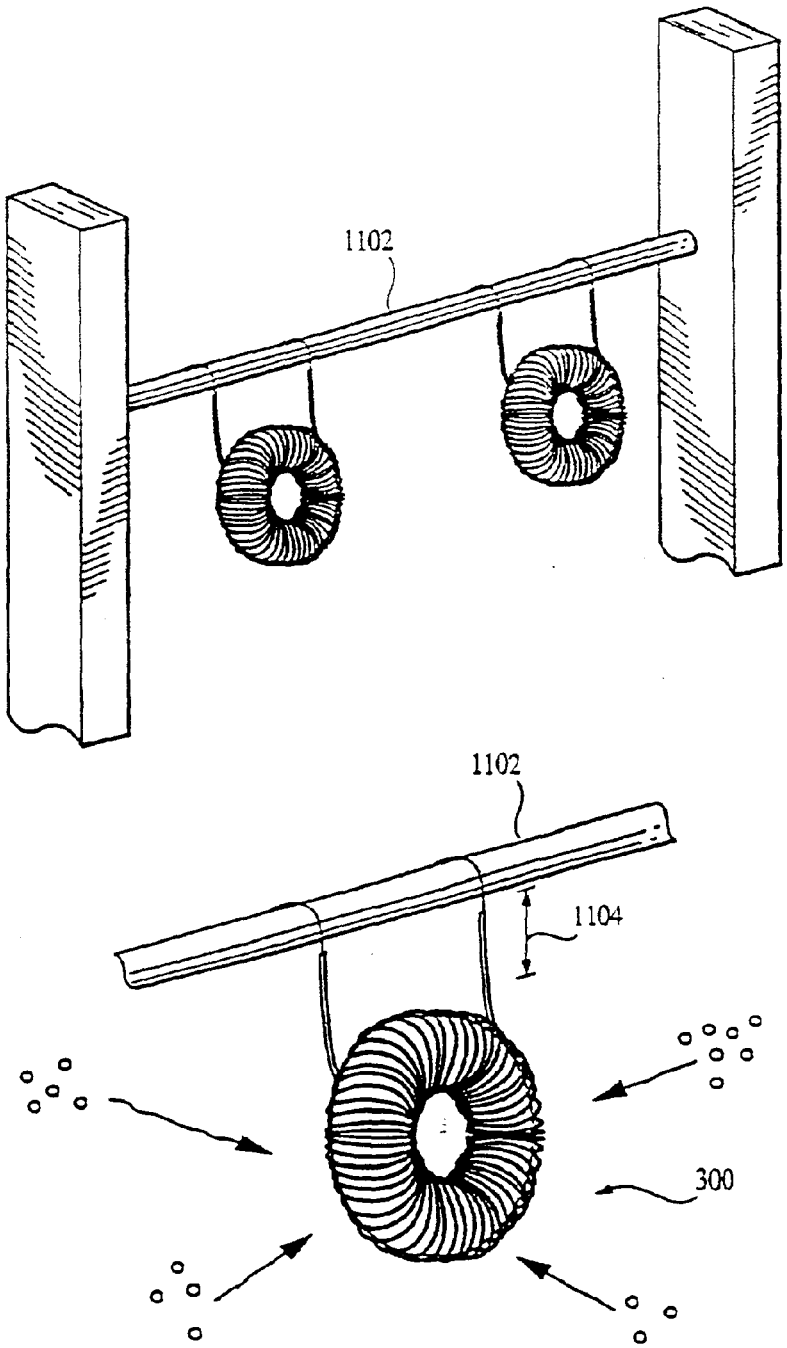

It is certified that error appears in the above-identified patent and that said Letters Patent is hereby corrected as shown below:

Drawings,
Sheet 19 of 19, “figures 11 and 12” should read -- Figure 11 --

Signed and Sealed this

Twenty-fourth Day of August, 2004

JON W. DUDAS
*Director of the United States Patent and Trademark Office*